United States Patent [19]

Perotto

[11] Patent Number: 4,976,795

[45] Date of Patent: Dec. 11, 1990

[54] SOLID GAS-GENERATING COMPOSITION AND ITS USE IN GAS GENERATORS FOR INFLATABLE CUSHIONS INTENDED TO PROTECT THE PASSENGERS OF A MOTOR VEHICLE

[75] Inventor: Christian Perotto, Ballancourt, France

[73] Assignee: S.N.C. Livbag, Vert Le Petit, France

[21] Appl. No.: 533,178

[22] Filed: Jun. 4, 1990

[30] Foreign Application Priority Data

Jun. 21, 1989 [FR] France ..... 89 08224

[51] Int. Cl.[5] ..... C06B 45/10

[52] U.S. Cl. ..... 149/19.4; 149/19.6; 149/35

[58] Field of Search ..... 149/19.4, 19.6, 35

[56] References Cited

U.S. PATENT DOCUMENTS

| | | | |
|---|---|---|---|
| 4,243,443 | 1/1981 | Vtracki | 149/35 |
| 4,288,262 | 9/1981 | Flanagan et al. | 149/19.6 |
| 4,405,392 | 9/1983 | Hobbs et al. | 149/35 |
| 4,919,737 | 4/1990 | Biddle et al. | 149/19.6 |

*Primary Examiner*—Stephen J. Lechert, Jr.
*Attorney, Agent, or Firm*—Bucknam and Archer

[57] ABSTRACT

The present invention relates to new pyrotechnic compositions generating nontoxic cold gases.

The compositions according to the invention contain between 55% and 71% by weight of alkali or alkaline-earth metal azide, between 25% and 40% by weight of molybdenum sulphide and between 3% and 6% by weight of a binder consisting of the product of reaction of a polyglycidyl azide containing hydroxyl ends with at least one polyisocyanate. A preferred composition comprises 35% by weight of molybdenum sulphide, 60% by weight of sodium azide and 5% by weight of a binder obtained by reaction of a polyglycidyl azide containing OH hydroxyl ends of mass 2000 with the hexamethylene diisocyanate biuret trimer.

The compositions according to the invention are much less sensitive to external attacks, and especially to moisture, than the conventional compositions based on azide and molybdenum sulphide. They are particularly suitable for the generators of nontosic cold gases intended for inflating the safety cushions of motor vehicles.

12 Claims, No Drawings

SOLID GAS-GENERATING COMPOSITION AND ITS USE IN GAS GENERATORS FOR INFLATABLE CUSHIONS INTENDED TO PROTECT THE PASSENGERS OF A MOTOR VEHICLE

The present invention relates to the field of the protection, in the event of impact, of passengers of a motor vehicle by a cushion capable of being inflated by means of a pyrotechnic generator of nontoxic cold gases. More precisely, the invention relates to a new solid gas-generating composition based on molybdenum sulphide and alkali or alkaline-earth metal azide and to its use in a gas generator of this kind.

It is known to provide the passengers of a motor vehicle with protection against impact by virtue of cushions which inflate at the time of impact under the effect of gas originating from a pyrotechnic gas-generator initiated by an impact detector. The generation of the gases takes place by combustion of a solid composition in the said generator, which generates gases which are cooled and filtered before entering the said cushion.

To ensure a satisfactory operation of the gas generator, the solid composition, which generally takes the form of pellets or small blocks, must meet a number of essential requirements:

(a) it must have a very high speed of combustion so as to ensure the inflation of the cushion within periods of a few tens of milliseconds, but without being explosive, (b) it must generate so-called "cold" gases so that, after quickly passing through the cooling device of the generator, these cold gases enter the cushion at a temperature which can be tolerated by the passenger's body. It is generally accepted that these "cold" gases must have a combustion temperature which must not exceed 500° C.-600° C., (c) it must generate gases which are not toxic to the passengers, (d) lastly, to avoid any unnecessary fire risk, it must generate inert gases.

Nitrogen-generating compositions are particularly sought after for these last two reasons. Among nitrogen-generating compositions, solid compositions based on an alkali or alkaline-earth metal azide and molybdenum sulphide, optionally in the presence of sulphur, have been found to meet the first two requirements particularly well, namely the high speed of combustion and a moderate combustion temperature. Such compositions are described, for example, in U.S. Pat. Nos. 3,741,585, 4,203,787 and 4,547,235. These compositions are perfectly satisfactory in respect of the generation of nontoxic cold gases for motor vehicle safety, but present some disadvantages in use and storage, these being linked with the presence of metal azides, which are explosive and moisture-sensitive substances whose hydrolysis products are themselves hazardous explosives.

These disadvantages in use, which are described, for example, in U.S. Pat. No. 4,370,181, have led the specialists to investigate compositions based on molybdenum sulphide but without azide. The abovementioned U.S. Pat. No. 4,370,181 thus proposes compositions generating nontoxic cold gases, based on molybdenum sulphide and a nonhydrogenated tetrazole compound. However, such compositions exhibit the disadvantage of making use of a product which is not readily available commercially; in fact, nonhydrogenated tetrazole compounds such as bitetrazole are not widely distributed industrial products and, furthermore, these compositions are not easy to pelletize.

It is known, furthermore, that the azide functional group can be introduced into a composition by some polymers bearing this group, such as, for example, polyglycidyl azide.

For example, U.S. Pat. No. 4,601,344 describes gas-generating compositions for extinguishers, which consist, on the one hand, of tetrazole compounds and, on the other hand, of a binder based on polyglycidyl azide. However, such compositions exhibit the disadvantage of generating toxic gases in concentrations which are incompatible with motor vehicle safety requirements.

In the field of the protection of the passengers of a motor vehicle by an inflatable cushion, the specialist is therefore still looking for a gas-generating composition which exhibits all the advantages of the compositions based on molybdenum sulphide and alkali or alkaline-earth metal azides without exhibiting their disadvantages in use and in storage.

The objective of the present invention is precisely to propose a composition of this kind. The subject of the invention concerns a solid composition generating nontoxic cold gases, comprising molybdenum sulphide and an alkali or alkaline-earth metal azide, characterized in that it contains between 3% and 6% by weight relative to the total weight of the said composition of a binder consisting of the product of reaction of a polyglycidyl azide containing hydroxyl ends with at least one polyisocyanate chosen from the group consisting of diisocyanates and triisocyanates.

According to a first preferred embodiment of the invention, the said azide is sodium azide.

According to a second preferred embodiment of the invention, a part of the molybdenum sulphide is replaced by sulphur.

The invention also relates to the use of a composition of this kind in a gas generator for an inflatable safety cushion intended for motor vehicles.

In fact, it has surprisingly been found by the Applicant Company that when a low proportion—between 3% and 6% by weight relative to the total weight of the composition—of the metal azides in a conventional composition based on molybdenum sulphide and alkali or alkaline-earth metal azide is replaced with a polyurethane binder based on polyglycidyl azide, then a composition generating nontoxic, cold gases, at a high speed of combustion, is obtained, which no longer exhibits the disadvantages of the said conventional compositions in use and in storage.

The compositions according to the invention are thus particularly suitable for the pyrotechnic gas generators intended for inflating the safety cushions of motor vehicles.

A detailed description of the invention is given below.

The invention relates to compositions based on molybdenum sulphide and alkali or alkaline-earth metal azide such as, for example, sodium azide, lithium azide, strontium azide or calcium azide.

According to a first preferred embodiment of the invention, sodium azide will be employed.

Characteristically, the compositions according to the invention contain between 3% and 6% by weight relative to the total weight of the said composition of a binder consisting of the product of reaction of a polyglycidyl azide containing OH hydroxyl ends with at least one polyisocyanate chosen from the group consisting of diisocyanates and triisocyanates.

The polyglycidyl azides containing OH hydroxyl ends which may be employed within the scope of the present invention are polyethers of general formula:

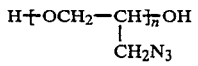

in which C, H, O and N denote carbon, hydrogen, oxygen and nitrogen respectively and where n denotes an integer between 5 and 100.

These polymers are generally obtained by reaction of sodium azide with a polyepichlorohydrin, as described, for example, in U.S. Pat. Nos. 4,268,450, 4,379,894 or 4,486,351. Polyglycidyl azides whose molecular mass is between 600 and 7000 will generally be employed and preference will be given to those whose molecular mass is between 1500 and 2500.

The polyisocyanate employed may be the usual aliphatic, cycloaliphatic or aromatic diisocyanates and triisocyanates such as, for example, 1-methyl-2,4-cyclohexane diisocyanate, 1-methyl-2,6-cyclohexane diisocyanate, 4,4'-dicyclohexylmethane diisocyanate, isophorone diisocyanate, methylene diisocyanate, 1,6-hexane diisocyanate, 2,2,4-trimethyl-1,6-hexane diisocyanate, toluene diisocyanate, hexamethylene diisocyanate biuret trimer and polymethylenepolyphenyl isocyanate.

However, the preferred polyisocyanate will be the hexamethylene diisocyanate biuret trimer of formula:

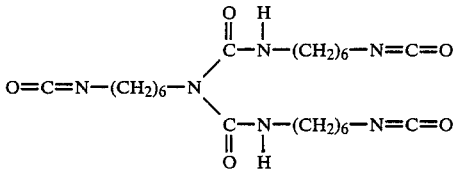

and the polymethylenepolyphenyl isocyanates of formula:

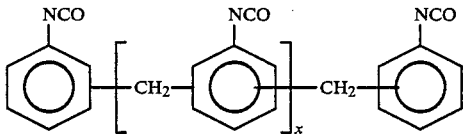

in which x denotes an integer or zero and which have an average NCO group functionality of 2.7.

The NCO:OH ratio in the formulation of the binder according to the invention is close to 1:1.

As already stated above, a characteristic of the invention lies in the fact that the weight content of binder in the composition lies in a very precise range, of between 3% and 6% relative to the total weight of the composition, so that the composition retains the advantages of the conventional compositions based on molybdenum sulphide and sodium azide in respect of the nontoxicity of the gases, while being easier to use and to store by virtue of the fact that the azide particles are at least partially coated with a binder. According to a preferred embodiment of the invention, the weight content of binder in the composition is between 4% and 5% relative to the total weight of the composition.

In these conditions, the weight content of azide in the composition is advantageously between 55% and 71% relative to the total weight of the composition, and the weight content of molybdenum sulphide is advantageously between 25% and 40% relative to the total weight of the composition.

According to a last preferred alternative form of the invention, part of the molybdenum sulphide may be replaced with sulphur. In this case, the weight content of sulphur in the composition must be lower than 8% relative to the total weight of the composition, the overall content of sulphur and of molybdenum sulphide in the composition being between 25% and 40% relative to the total weight of the composition.

The formulation of the compositions according to the invention is advantageously carried out in the following manner.

The solid constituents, namely the azide, molybdenum sulphide and, optionally, sulphur are mixed in a powder mixer. A solution of polyglycidyl azide and of isocyanate in a nonreactive volatile anhydrous solvent such as, for example, methylene chloride is prepared in a liquid mixer. A solution of 50:50 by volume of, on the one hand, the solvent and, on the other hand, the constituents of the binder is advantageously produced. The mixture of the solid constituents and the said solution are then introduced into a kneader, catalysts intended to promote the reaction of the isocyanate with the polyglycidyl azide, such as dibutyltin dilaurate or iron acetylacetonate are optionally added, and kneading is carried out under vacuum to strip off the solvent. A powder is then obtained, which can be formed by pelletizing or compression. The pellets or blocks thus obtained are then cooked in an oven heated to a temperature of between 60° C. and 100° C. to complete the cross-linking of the binder.

The pellets or blocks thus obtained burn at a moderate temperature at high speeds of combustion, releasing a large volume of gases which are nontoxic within the meaning of the standards imposed by the motor vehicle manufacturers, these gases consisting essentially of nitrogen. It has been ascertained, furthermore, that the pellets or blocks of compositions according to the invention are much less sensitive to external attacks, especially to moisture, than the pellets or blocks of conventional compositions based on alkali or alkaline-earth metal azide and molybdenum sulphide.

The compositions according to the invention may thus be advantageously employed to form the pyrotechnic charge of the generators of nontoxic cold gases intended for inflating the safety cushions of motor vehicles.

EXAMPLE

Pellets corresponding to the following composition were manufactured:

molybdenum sulphide: 35% by weight
sodium azide: 60% by weight
binder: 5% by weight The binder was obtained by reaction of a polyglycidyl azide containing OH hydroxyl ends, of average molecular mass of 2000 with the hexamethylene diisocyanate biuret trimer. Dibutyltin dilaurate was employed as catalyst.

The pellets obtained burn at a speed of 7 mm/s under 7 MPa in a manometer bomb. The combustion temperature is 867 K, that is 594° C.

Analysis of the unfiltered combustion gases gives a percentage of nitrogen higher than 99%, a carbon monoxide CO content below 120 ppm and a nitrogen oxides ($NO+NO_2$) content below 0.5 ppm.

What is claimed is:

1. Solid composition generating nontoxic gases, comprising molybdenum sulphide and an alkali or alkaline-earth metal azide, characterized in that it contains between 3% and 6% by weight relative to the total weight of the said composition of a binder consisting of the product of reaction of a polyglycidyl azide containing hydroxyl ends with at least one polyisocyanate chosen from the group consisting of diisocyanates and triisocyanates.

2. Composition according to claim 1, characterized in that the said azide is chosen from the group consisting of sodium azide, lithium azide, strontium azide and calcium azide.

3. Composition according to claim 2, characterized in that the said azide is sodium azide.

4. Composition according to claim 1, characterized in that the weight content of azide is between 55% and 71% relative to the total weight of the said composition.

5. Composition according to claim 1, characterized in that the said polyglycidyl azide containing hydroxyl ends has an average molecular mass of between 1000 and 7000.

6. Composition according to claim 5, characterized in that the said polyglycidyl azide containing hydroxyl ends has an average molecular mass of between 1500 and 2500.

7. Composition according to claim 1, characterized in that the said polyisocyanate is chosen from the group consisting of the hexamethylene diisocyanate biuret trimer and polymethylenepolyphenyl isocyanate.

8. Composition according to claim 1, characterized in that the weight content of binder is between 4% and 5% relative to the total weight of the said composition.

9. Composition according to claim 1, characterized in that the weight content of molybdenum sulphide is between 25% and 40% relative to the total weight of the said composition.

10. Composition according to claim 1, characterized in that part of the molybdenum sulphide is replaced with sulphur.

11. Composition according to claim 10, characterized in that the weight content of sulphur is lower than 8% relative to the total weight of the said composition.

12. Use of a composition according to any one of claims 1 to 11 in a gas generator for an inflatable safety cushion intended for motor vehicles.

* * * * *